US008914927B1

(12) United States Patent
Leach

(10) Patent No.: US 8,914,927 B1
(45) Date of Patent: Dec. 23, 2014

(54) INFANT SUPPORT PILLOW WITH ATTACHED ACTIVITY MAT

(71) Applicant: Jamie S. Leach, Ada, OK (US)

(72) Inventor: Jamie S. Leach, Ada, OK (US)

( * ) Notice: Subject to any disclaimer, the term of this patent is extended or adjusted under 35 U.S.C. 154(b) by 0 days.

(21) Appl. No.: 14/108,639

(22) Filed: Dec. 17, 2013

(51) Int. Cl.
*A47D 13/00* (2006.01)
*A47D 11/00* (2006.01)

(52) U.S. Cl.
CPC ..... *A47D 11/007* (2013.01); *Y10S 5/946* (2013.01)
USPC ..... 5/655; 5/417; 5/420; 5/640; 5/657.5; 5/946

(58) Field of Classification Search
USPC ..... 5/417, 419, 420, 640, 655, 657.5, 657, 5/722, 738, 739, 945, 946
See application file for complete search history.

(56) References Cited

U.S. PATENT DOCUMENTS

| | | | | | |
|---|---|---|---|---|---|
| 1,967,067 | A | | 7/1934 | Rightmire | |
| 2,626,407 | A | * | 1/1953 | Kurry | 5/99.1 |
| 4,227,270 | A | | 10/1980 | Rivera | |
| 4,712,258 | A | * | 12/1987 | Eves | 5/424 |
| 4,834,459 | A | | 5/1989 | Leach | |
| 4,861,109 | A | | 8/1989 | Leach | |
| D309,018 | S | | 7/1990 | Leach | |
| 4,980,937 | A | * | 1/1991 | Mason et al. | 5/655 |
| 4,999,863 | A | * | 3/1991 | Kane | 5/98.1 |
| 5,022,107 | A | | 6/1991 | Knotts | |
| 5,035,013 | A | * | 7/1991 | Bloom | 5/420 |
| 5,103,514 | A | | 4/1992 | Leach | |
| D328,683 | S | | 8/1992 | Kalozdi | |
| 5,325,818 | A | | 7/1994 | Leach | |
| 5,367,730 | A | | 11/1994 | Sher | |
| 5,546,620 | A | * | 8/1996 | Matthews | 5/655 |
| 5,551,108 | A | | 9/1996 | Butler, III | |
| 5,586,351 | A | | 12/1996 | Ive | |
| 5,647,076 | A | | 7/1997 | Gearhart | |
| 6,026,525 | A | * | 2/2000 | Davis | 5/99.1 |
| 6,036,263 | A | | 3/2000 | Gold | |
| 6,044,505 | A | | 4/2000 | Friedman | |
| 6,189,169 | B1 | | 2/2001 | Marcotte | |
| 6,343,727 | B1 | | 2/2002 | Leach | |
| 6,363,558 | B1 | | 4/2002 | Dunne | |

(Continued)

OTHER PUBLICATIONS

The Leachco Bath 'N Bumper product, which is shown and described in the packaging card attached as Exhibit A to this Statement, was in public use and/or on sale at least as early as about Aug. 1999.

(Continued)

*Primary Examiner* — William Kelleher
*Assistant Examiner* — David R Hare
(74) *Attorney, Agent, or Firm* — Mary M. Lee

(57) ABSTRACT

A pillow and play mat assembly comprising an infant support pillow with an attached activity or play mat. The pillow includes a bolster surrounding a recessed central well. The mat includes a padded panel with a flexible bumper. The bumper is repositionable so that it can extend from the panel upwardly or downwardly. In the fully deployed or play mode, the play mat extends sidewardly from the support pillow and the bumper extends upwardly to enclose the play area defined by the mat. In the stowed or carrying mode, the play mat is folded under the support pillow and the bumper is inverted to at least partially enclose the side of the pillow. In an intermediate position, the play mat is folded under the pillow and the bumper extends downwardly to slightly elevate the pillow.

14 Claims, 7 Drawing Sheets

(56) References Cited

U.S. PATENT DOCUMENTS

| | | | | |
|---|---|---|---|---|
| 6,408,463 | B1 * | 6/2002 | Palacio | 5/424 |
| 6,427,251 | B1 | 8/2002 | Leach | |
| 6,499,164 | B1 | 12/2002 | Leach | |
| 6,553,590 | B1 | 4/2003 | Leach | |
| 6,601,252 | B1 | 8/2003 | Leach | |
| 6,751,817 | B1 | 6/2004 | Leach | |
| 6,760,934 | B1 | 7/2004 | Leach | |
| 6,857,150 | B2 * | 2/2005 | Matthews Brown et al. | 5/655 |
| 7,000,275 | B2 * | 2/2006 | Matthews Brown et al. | 5/655 |
| 7,010,821 | B1 | 3/2006 | Leach | |
| 7,114,206 | B2 | 10/2006 | Leach | |
| 7,290,303 | B2 * | 11/2007 | Mead et al. | 5/655 |
| 7,353,552 | B2 | 4/2008 | Leach | |
| 7,472,443 | B2 * | 1/2009 | Littlehorn et al. | 5/632 |
| 7,500,278 | B2 * | 3/2009 | Leach | 5/655 |
| 7,513,001 | B1 * | 4/2009 | Leach | 5/655 |
| 7,562,406 | B1 * | 7/2009 | Leach | 5/655 |
| 7,624,461 | B2 * | 12/2009 | Tidwell et al. | 5/655 |
| 7,661,158 | B2 * | 2/2010 | Daeseleire | 5/102 |
| 7,676,871 | B1 * | 3/2010 | Leach | 5/655 |
| 7,708,342 | B2 | 5/2010 | Leach | |
| 7,788,752 | B2 | 9/2010 | Tidwell et al. | |
| 7,793,371 | B1 | 9/2010 | Leach | |
| 7,856,688 | B2 * | 12/2010 | Dockendorf | 5/655 |
| 7,878,587 | B1 | 2/2011 | Leach | |
| 7,926,135 | B1 | 4/2011 | Leach | |
| 8,136,186 | B1 | 3/2012 | Leach | |
| 8,146,760 | B1 | 4/2012 | Leach | |
| D673,791 | S | 1/2013 | Furuland | |
| 8,418,295 | B2 | 4/2013 | Clark | |
| 8,419,128 | B1 | 4/2013 | Leach | |
| D681,995 | S | 5/2013 | Davis et al. | |
| 8,448,275 | B1 | 5/2013 | Leach | |
| 8,458,830 | B1 | 6/2013 | Pierce et al. | |
| 8,468,627 | B2 | 6/2013 | Leach | |
| 8,479,334 | B1 | 7/2013 | Leach | |
| 8,495,775 | B2 * | 7/2013 | Fair et al. | 5/655 |
| 8,516,638 | B2 | 8/2013 | Kummerfled et al. | |
| 8,555,429 | B2 * | 10/2013 | Leach | 4/572.1 |
| 8,627,520 | B1 * | 1/2014 | Morton | 5/99.1 |
| 8,661,587 | B1 | 3/2014 | Leach | |
| 8,661,588 | B1 | 3/2014 | Leach | |
| 8,671,480 | B1 | 3/2014 | Leach | |
| 8,763,183 | B2 * | 7/2014 | Tidwell | 5/655 |
| 2005/0076443 | A1 * | 4/2005 | Kruger, Jr. | 5/636 |
| 2005/0278864 | A1 | 12/2005 | Leach | |
| 2007/0022526 | A1 | 2/2007 | Leach | |
| 2007/0028384 | A1 | 2/2007 | Leach | |
| 2007/0046084 | A1 | 3/2007 | Leach | |
| 2007/0151031 | A1 | 7/2007 | Leach | |
| 2007/0245491 | A1 * | 10/2007 | Korbonski | 5/417 |
| 2007/0277321 | A1 | 12/2007 | Leach | |
| 2008/0040854 | A1 * | 2/2008 | Lorentz | 5/417 |
| 2009/0007336 | A1 * | 1/2009 | Kassai et al. | 5/655 |
| 2009/0007337 | A1 * | 1/2009 | Mese | 5/655 |
| 2010/0186165 | A1 | 7/2010 | Marciano | |
| 2013/0125314 | A1 | 5/2013 | Kummerfeld et al. | |

OTHER PUBLICATIONS

The Leachco Tot Pod product, which is shown and described in the packaging card attached as Exhibit E to this Statement, was in public use and/or on sale at least as early as about Dec. 21, 2007.

The Leachco Flipper product, which is shown and described in the packaging card attached as Exhibit C to this Statement, was in public use and/or on sale at least as early as about Feb. 7, 2012.

The Leachco Safer Bather product, which is shown and described in the packaging card attached as Exhibit E to this Statement, was in public use and/or on sale at least as early as about Jul. 1994.

The Leachco Lilypod product, which is shown and described in the packaging card attached as Exhibit E to this Statement, was in public use and/or on sale at least as early as about Jul. 30, 2008.

The Leachco Tuckie Duckie product, which is shown and described in the packaging card attached as Exhibit E to this Statement, was in public use and/or on sale at least as early as about Jun. 10, 2005.

The Leachco Bumpzzz product, which is shown and described in the packaging card attached as Exhibit E to this Statement, was in public use and/or on sale at least as early as about Mar. 27, 2012.

The Leachco Nap n Pack product, which is shown and described in the packaging card attached as Exhibit E to this Statement, was in public use and/or on sale at least as early as about Jul. 1994.

The Leachco Roam 'n Holiday product, which is shown and described in the packaging card attached as Exhibit E to this Statement, was in public use and/or on sale at least as early as about Aug. 8, 2005.

The Leachco Playpod product, which is shown and described in the packaging card attached as Exhibit E to this Statement, was in public use and/or on sale at least as early as about Sep. 10, 2009.

The Leachco Podster product, which is shown and described in the packaging card attached as Exhibit E to this Statement, was in public use and/or on sale at least as early as about Jan. 21, 2009.

The Leachco Pillay product, which is shown and described in the packaging card attached as Exhibit E to this Statement, was in public use and/or on sale at least as early as about Apr. 6, 2009.

* cited by examiner

INFANT SUPPORT PILLOW WITH ATTACHED ACTIVITY MAT

FIELD OF THE INVENTION

The present invention relates generally to infant support pillows and play mats for infants.

DETAILED DESCRIPTION OF THE PREFERRED EMBODIMENT(S)

Both infant support pillows and infant activity mats are popular items for the nursery. The present invention provides an assembly that includes both an infant support pillow and an attached play mat. In the extended or play configuration, the play mat extends out to the side of the pillow and the play mat sidewall is folded upward to partially enclose the play area. In the collapsed position, the bumper is inverted and the mat is folded back under the pillow. In this mode, the inverted bumper of the mat at least partially encloses the pillow. In this compact configuration, the assembly can be used simply as an infant support pillow, or it can be stored, or it can be carried using a built in handle.

Figure 1:
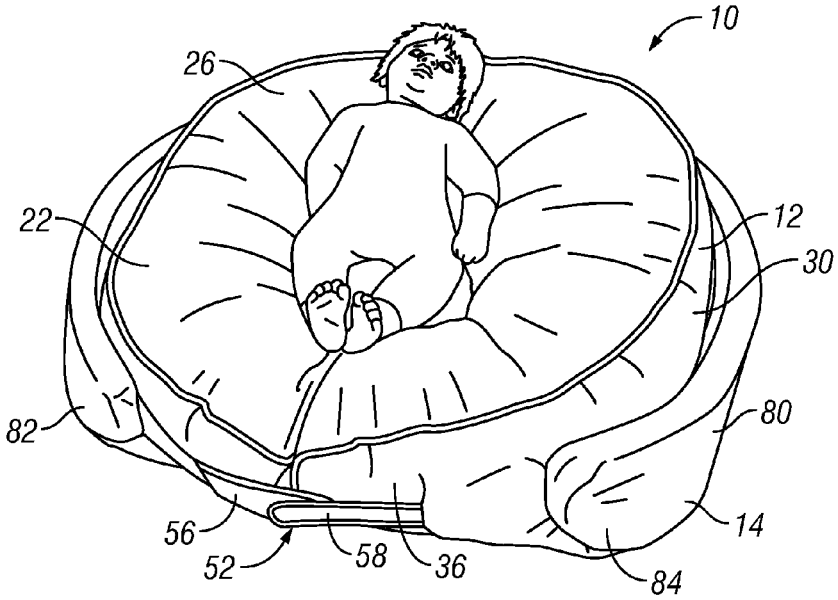
FIG. 1 is a frontal perspective view of a pillow and play mat assembly made in accordance with a preferred embodiment of the present invention.

Turning now to the drawings in general and to FIG. 1 in particular, there is shown therein a pillow and play mat assembly made in accordance with a preferred embodiment of the present invention and designated generally by the reference numeral 10. The pillow and mat assembly 10 preferably comprises an infant support pillow 12 with an attached infant activity mat 14.

A preferred infant support pillow is disclosed in U.S. Pat. No. 7,676,871, entitled "Pillow Assembly with Adjustable Girth and Elastic Center Panel," granted Mar. 16, 2010, and the contents of this patent are incorporated herein by reference. Generally, the preferred pillow 12 comprises a central well 20 surrounded by a bolster 22. The pillow 12 has a top surface 26 and a bottom surface 28 and a sidewall 30 defining the perimeter 32 of the pillow. The perimeter 32 includes an attachment section 34 (see FIGS. 8 and 14).

Figure 2:
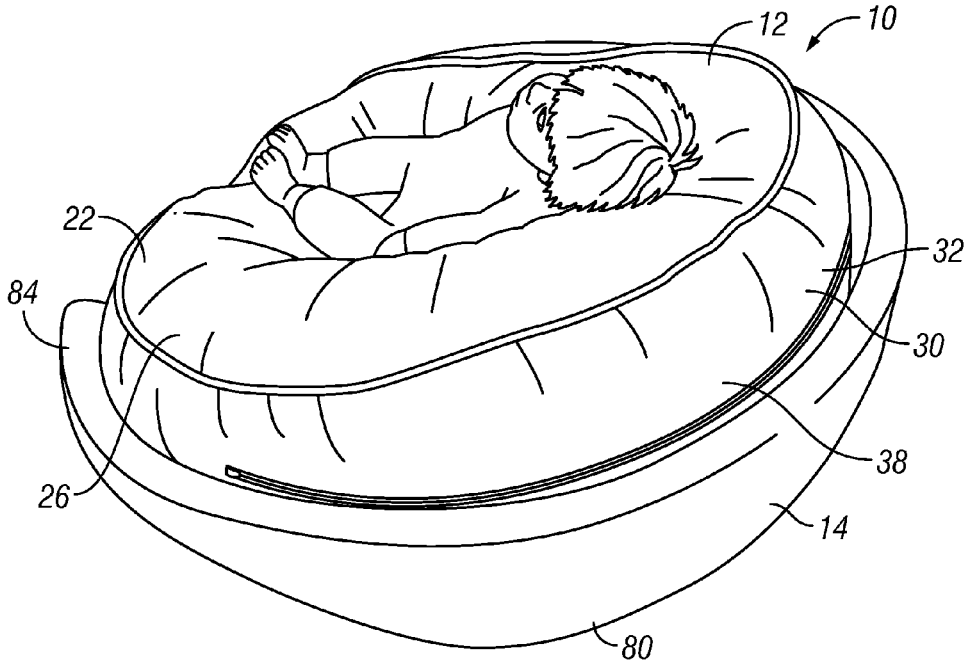
FIG. 2 is a rear perspective view of the pillow and play mat assembly shown in FIG. 1.
Figure 12:
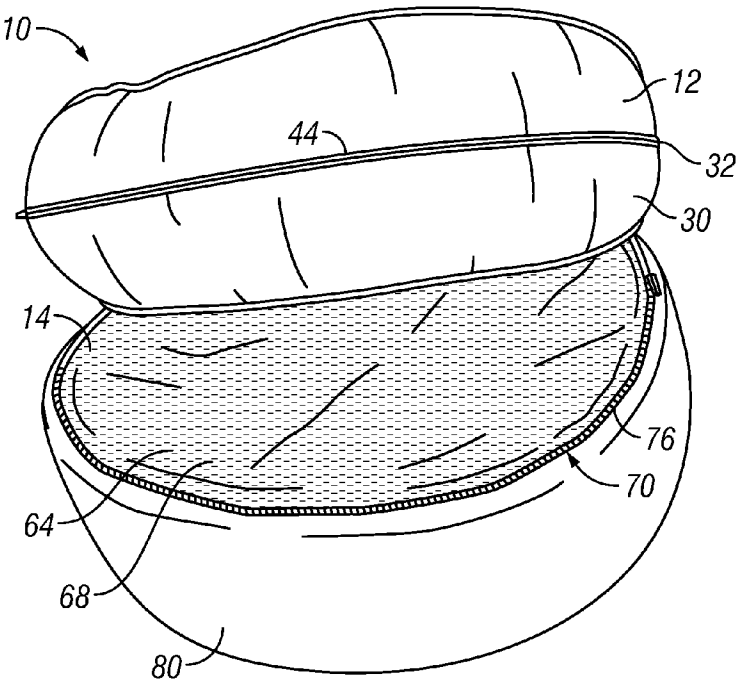
FIG. 12 is a rear perspective view of the pillow and play mat assembly in the intermediate position shown in FIG. 10 with the back of the support pillow slightly lifted to show the bottom surface of the play mat.

The size and shape of the pillow 12 may vary but generally should be sized to support the body of an infant in a prone position. In a most preferred embodiment, the overall shape of the pillow is round or oval with an outer diameter of about 20-30 inches, and most preferably about 25 inches. The pillow 12 may have a front 36 and a back 38 and may be thicker at the back than in the front providing a sloped top surface. That is, the thickness of the pillow gradually increases from the front 36 to the back 38, as best seen in FIGS. 1 and 2. This is desirable as it provides a comfortable reclining position for the infant when his bottom is positioned in the well 20 as shown.

Figure 7:
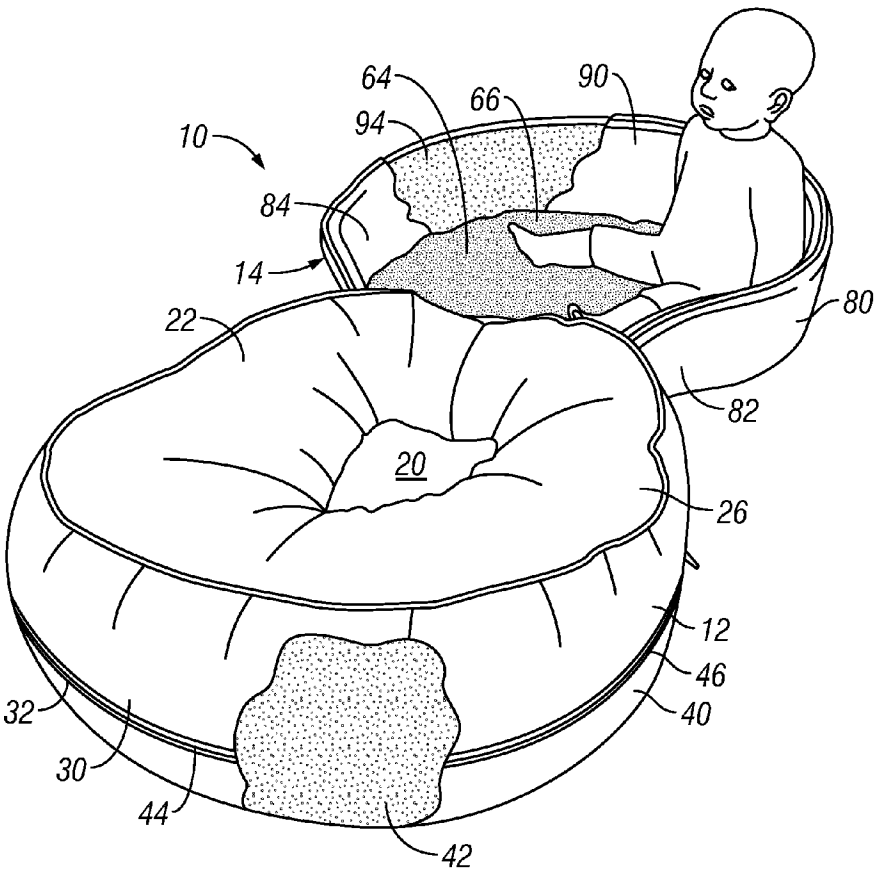
FIG. 7 is a rear perspective view of the fully deployed pillow and play mat assembly shown in FIG. 6.
Figure 6:
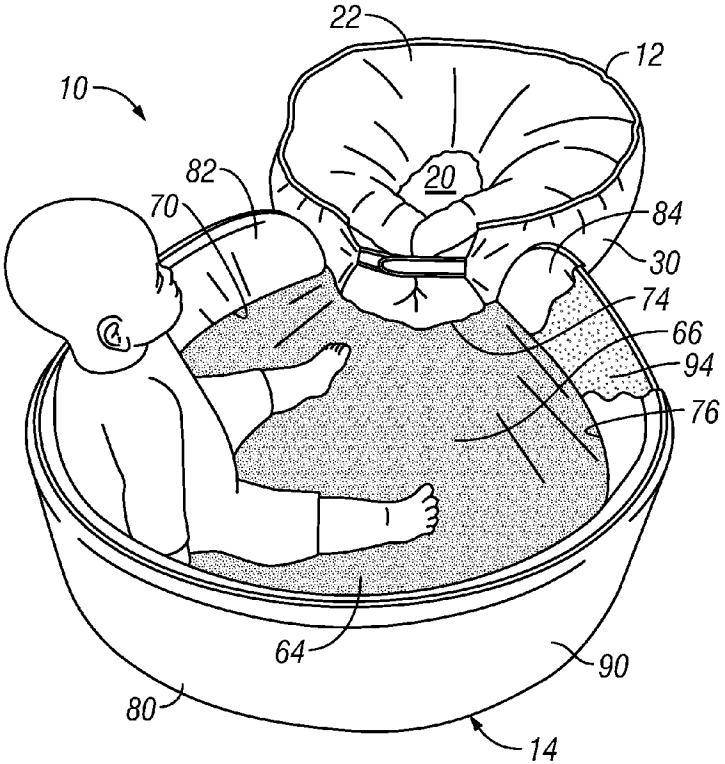
FIG. 6 is a frontal perspective view of the pillow and play mat assembly of FIG. 1 with the play mat fully deployed and the play mat bumper completely inverted to enclose the play area defined by the mat. The connecting straps are shown still in the handle configuration.

As seen in FIGS. 6 and 7, the most preferred pillow 12 may be comprised of a toroidal or donut-shaped fabric enclosure 40 that receives a C-shaped pillow insert 42 through an opening 44. While a zipper 46 is shown as the closure device for the opening 44, any other device for closing the opening may be substituted. Such devices include but are not limited to buttons, snaps, ties, hooks, hook-and-loop fasteners, or simply overlapping edges.

As used herein, "toroidal" is not limited to a circular configuration. Rather this term broadly denotes a pillow that may be oval, square, or other polygonal shape. Similarly, though a generally circular cross-sectional shape is preferred, it is not essential. For example, the cross-sectional shape of the pillow cover enclosure may be oval, square or some other polygonal shape. Still further, "toroidal" does not require that the cross-sectional diameter of the pillow bolster portion be the same around the entire circumference.

A preferred filler for the pillow insert 42 is polyester fiberfill, a loose filler than can be blown into an inner fabric cover or directly into the enclosure 40. Other suitable loose fillers that can be blown, poured or stuffed into the fabric enclosure 40 include down feathers and polystyrene pellets. Alternately, a solid body of memory foam or some other solid compressible material may be employed. In some instances, an inflatable inner liner may be preferred. This construction provides a continuous, compressible and resilient pillow 12, which can be deformed and reconfigured but will resume its original, resting shape when pressure is released.

Figure 3:
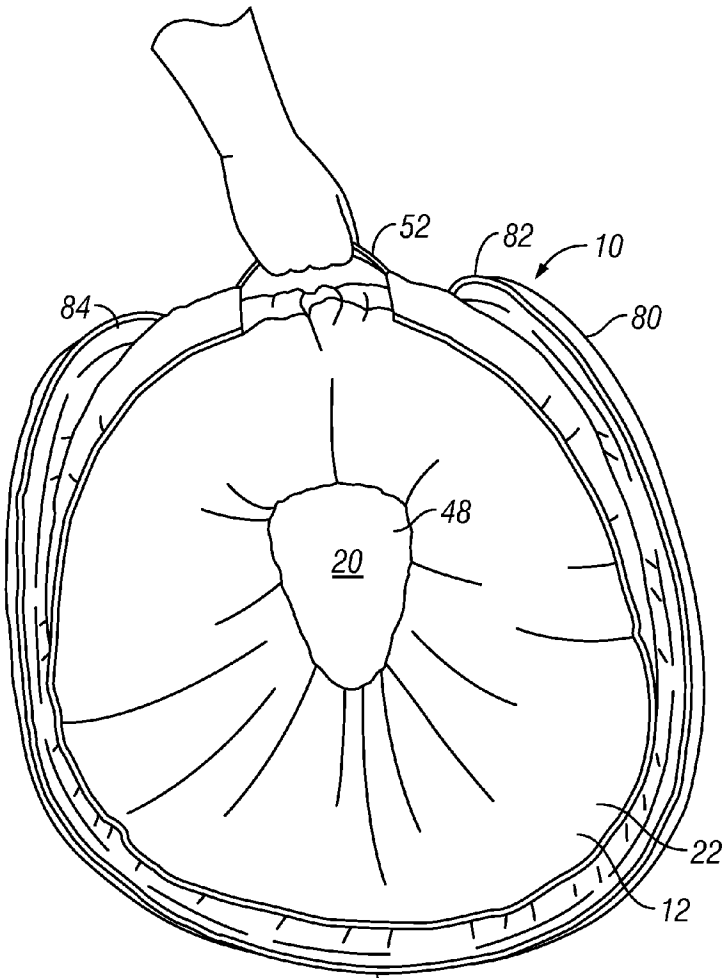
FIG. 3 is a side view of the pillow and play mat assembly of FIG. 1 in the carrying mode.
Figure 13:
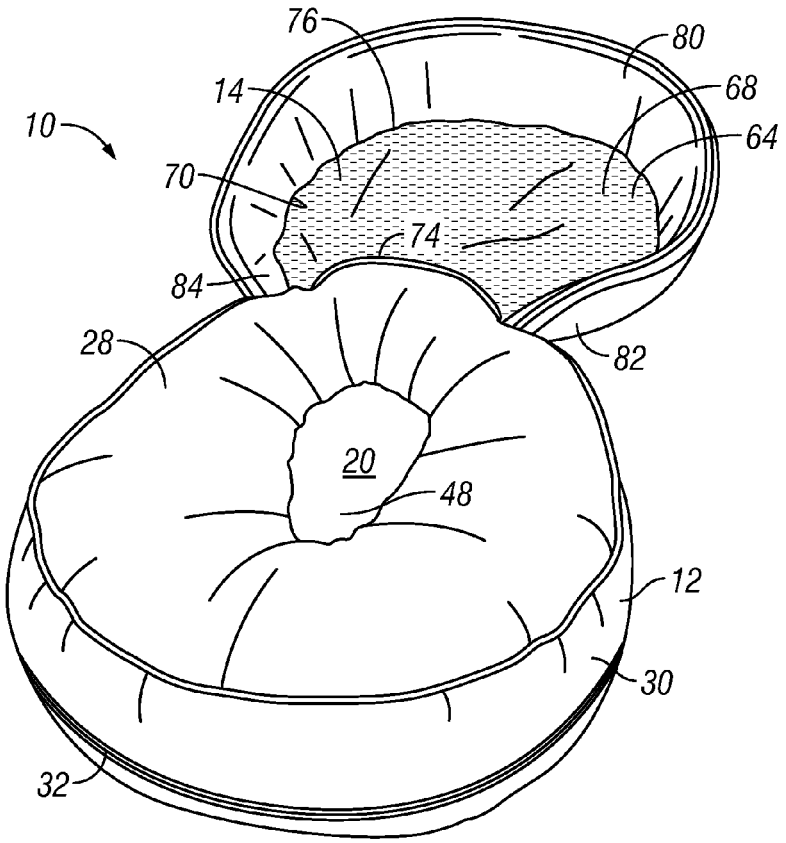
FIG. 13 a rear perspective view of the pillow and play mat assembly positioned bottom side up with the play mat opened out and bumper inverted.

The central well 20 may be an open center, but most advantageously includes a fabric panel 48 (FIGS. 3 and 13). Most advantageously, the panel 48 is elastic.

The pillow 12 may be provided with a cinch assembly 52 for adjusting the girth of the pillow. The cinch assembly 52 may comprise a pair of straps 56 and 58 provided with mating strips of hook-and-loop fastener material, designated generally as "f" in the drawings. This allows the straps 56 and 58 to be adjustably and removably connectable to each other. As best shown in FIGS. 1 and 3, when the straps 56 and 58 are interconnected, the cinch assembly 52 forms a conveniently placed handle for carrying the pillow assembly 10 when it is in the collapsed mode.

The structure of the play mat 14 is best appreciated when the assembly 10 is in the extended or deployed position, as seen in FIGS. 6 and 7, in which the play mat 14 extends sidewardly from the pillow 12. The play mat 14 comprises a panel 64, which may be padded or quilted material. The panel 64 has a top surface 66, a bottom surface 68, and a peripheral edge 70. The general size and shape of the panel 64 should be similar to the overall shape and size of the pillow 12. As used herein, "top surface" refers to that surface of the mat 14 that faces upward when the assembly is in the deployed position shown in FIGS. 6 and 7. This nomenclature is used for reference purposes only and not to be interpreted as limiting.

Figure 8:
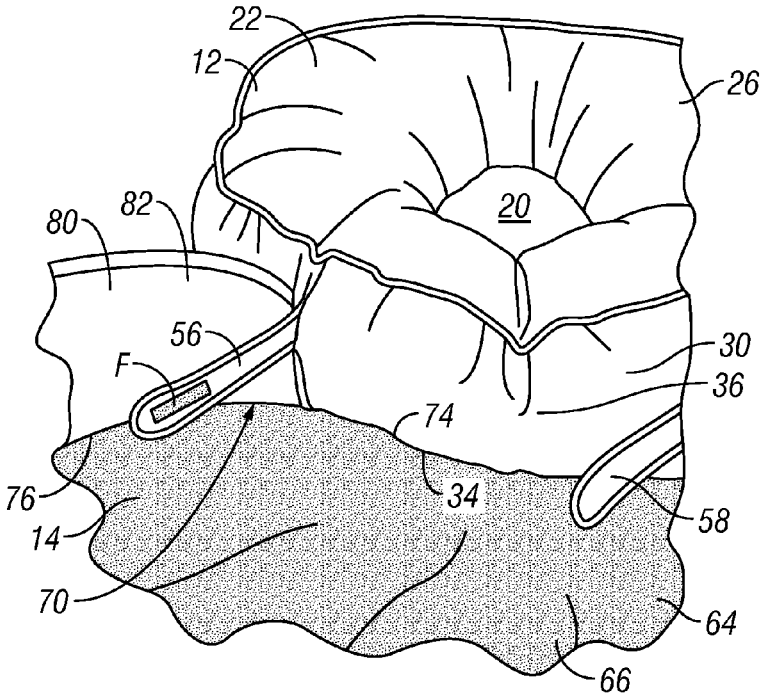
FIG. 8 is an enlarged, fragmented view of the junction between the support pillow and the play mat with the connecting straps loose and disconnected but still inside the play mat.
Figure 14:
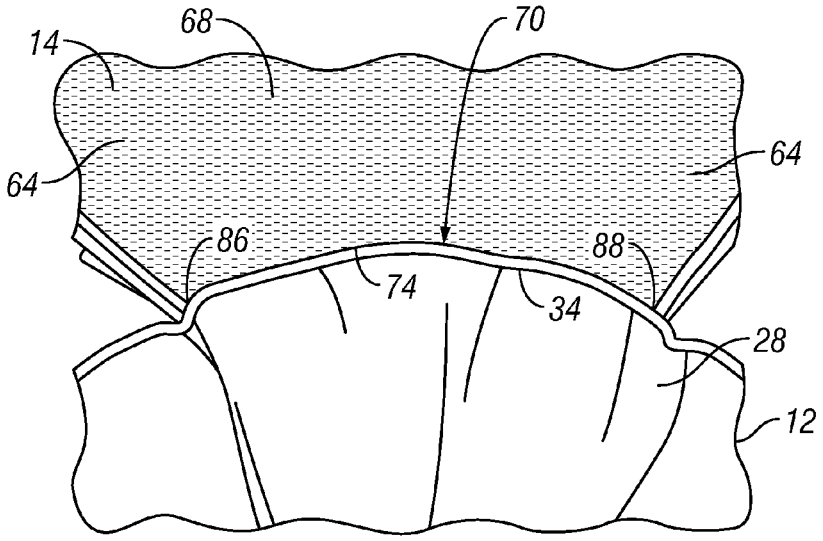
FIG. 14 is an enlarged, fragmented view of the seam connecting a portion of the periphery of the play mat and the edge of the pillow.

The peripheral edge 70 includes an attachment section 74 and a bumper section 76. The panel's attachment section 74 is engaged with the attachment section 34 of the support pillow 12. In the embodiment shown and described herein, this engagement is permanent. More specifically, the two edges are sewn together at a common seam, as best shown in FIGS. 8 and 14. However, the engagement between the two attachment sections 34 and 74 may be releasable so that the pillow 12 and mat 14 are separable.

The play mat 14 further comprises a flexible bumper 80 extending from the bumper section 76 of the peripheral edge 70 of the panel 64. When the assembly 10 is in the deployed position and the bumper 80 of the mat 14 is in the play position shown in FIGS. 6 and 7, the bumper 80 extends upwardly from the peripheral edge 70 to enclose the play area defined by the panel 64.

As best seen in FIGS. 6, 7, and 13, the bumper 80 is C-shaped having first and second ends 82 and 84. As shown in FIG. 14, the inter-engaged attachment sections 34 and 74 have a length extending between a first end 86 and a second end 88. Thus, most preferably, the first and second ends 82 and 84 of the bumper 80 abut the sidewall 30 of the pillow 12 when the play mat 14 is in the play position providing an uninterrupted enclosure around the mat. This will discourage at least smaller infants from straying off the mat 14.

The bumper 80 may be formed of a generally rectangular fabric enclosure 90. An opening 92 may extend along at least a portion of the enclosure 90 to allow the insertion and removal of a bumper insert 94 (FIGS. 6 & 7). The opening 92 preferably includes a zipper 96 or other closure device, such as buttons, snaps, ties, hooks, hook-and-loop fasteners, or simply overlapping edges. The bumper insert may be a solid elongate rectangle of foam or other compressible material. In this way, the bumper insert 94 and the pillow insert 42 may both be removed prior to laundering the assembly 10.

As mentioned above, the assembly 10 is shown in the collapsed position in FIGS. 1 and 2. In this position, the play mat 14 is folded underneath the support pillow 13 and the play mat bumper 80 is inverted and at least partially encloses the sidewall 30 of the pillow.

Figure 5:
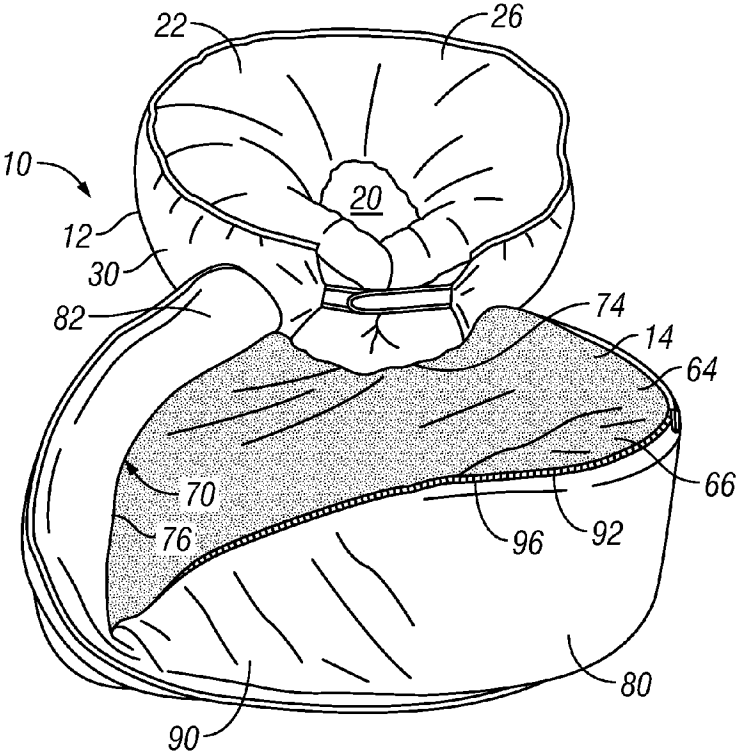
FIG. 5 is a frontal perspective view of the pillow and play mat assembly of FIG. 1 showing the inversion of the play mat's bumper in progress.
Figure 4:
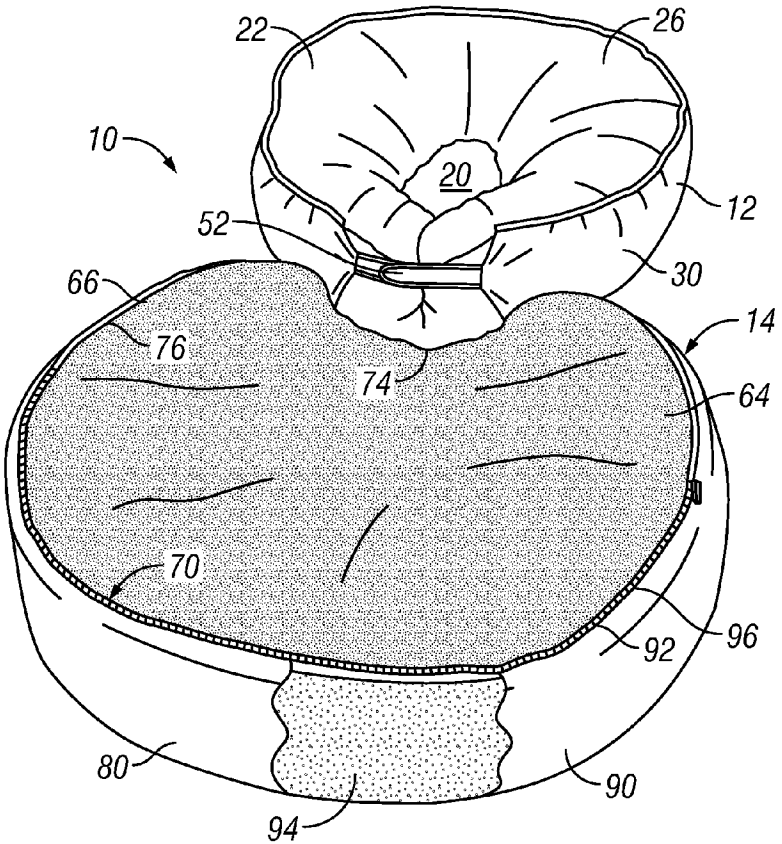
FIG. 4 is a frontal perspective view of the pillow and play mat assembly of FIG. 1 with the play mat partially deployed; the bumper still is directed downwardly.

With reference now to FIGS. 4-5, the reconfiguration of the assembly 10 from the collapsed position (FIGS. 1 and 2) to the extended or deployed position (FIGS. 6 and 7) will be described. First, the play mat 14 is unfolded, as shown in FIG. 4; the bumper 80 still is in the inverted position. Next, as seen in FIG. 5, the flexible bumper 80 is turned from the downward or inverted position (FIG. 4) to the play position shown in FIGS. 6 and 7.

Figure 9:
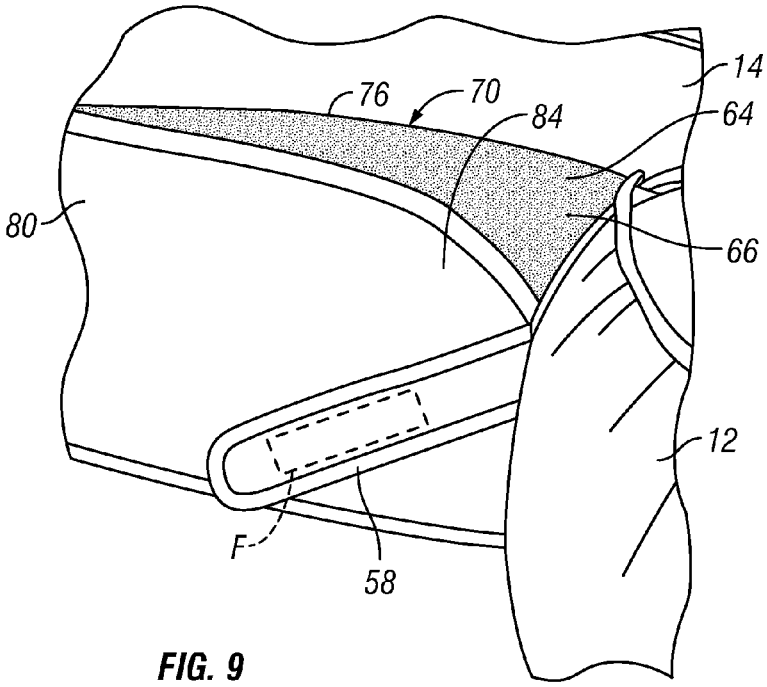
FIG. 9 is an enlarged, fragmented view of the junction between the support pillow and the play mat with the connecting straps connected to the outer surface of the sidewall to retain the sidewall in the upright position.
Figure 10:
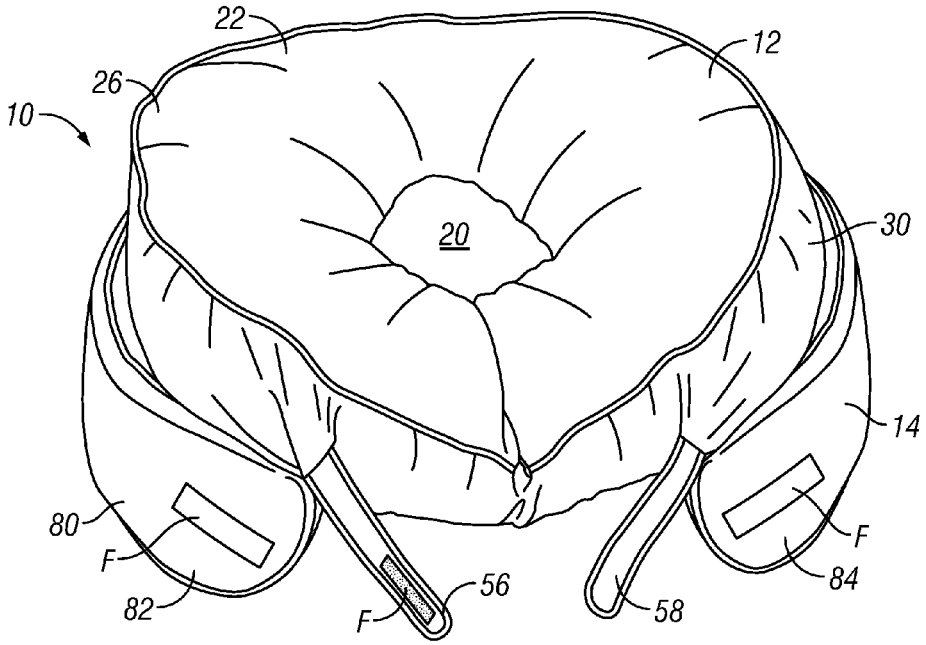
FIG. 10 is a frontal perspective view of the pillow and play mat assembly in an intermediate position with the play mat folded up under the support pillow. In this configuration, the downwardly extending bumper elevates the support pillow.
Figure 11:
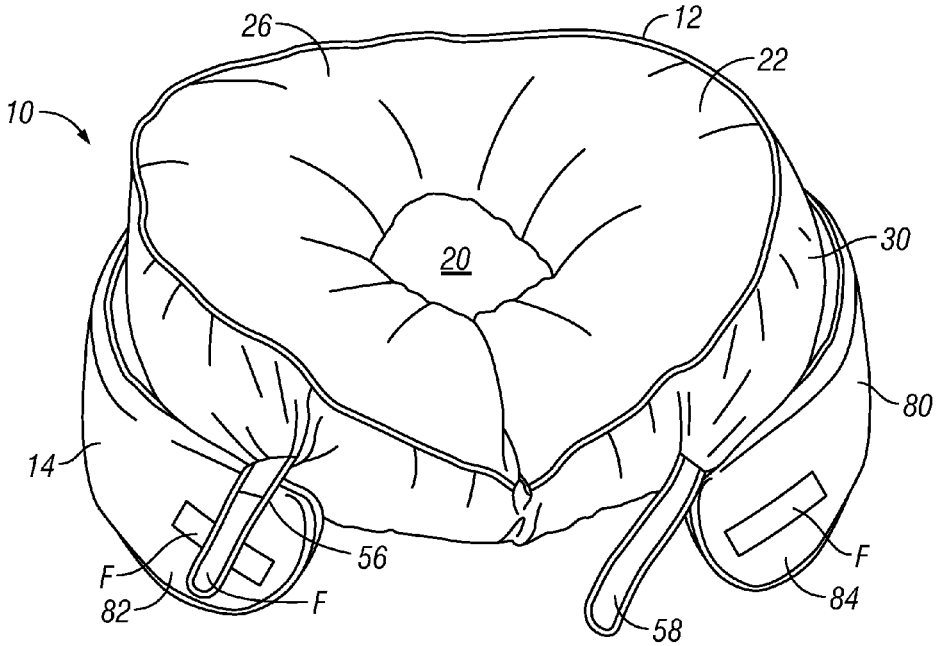
FIG. 11 is a frontal perspective view of the pillow and play mat assembly in the intermediate position shown in FIG. 10 showing how the connecting straps can be attached to and detached from the mating strips on the outer surface of the bumper.

In some cases, it is desirable to include tabs or straps for securing the ends 82 and 84 of the bumper 80 of the play mat 14 to the sidewall 30 of the pillow 12. Now it will be appreciated that the straps 56 and 58 of the cinch assembly can serve double duty to provide this purpose as well as the girth adjustment function. As explained previously, each of the ends of the straps 56 and 58 has hook and loop fastener strips "f." As seen in FIGS. 10 and 11, mating strips "f" also may be provided on the outer surface of the ends 82 and 84 of play mat's bumper 80. Additionally, the strap 56 will have fastener fabric strip (not shown) on its underside as well. Thus, as shown in FIGS. 8 and 9, the straps 56 and 58 may be separated and then repositioned on the outside of the respective first and second ends 82 and 84 of the bumper 80.

While the preferred embodiment of the present invention provides an ideal infant support pillow and activity mat assembly, its use is not so limited. Turning now to FIGS. 10-13, a third position for the assembly 10 will be described which is ideal for use as a pet bed. In this intermediate position, the play mat 14 is folded under the pillow 12, but the bumper 80 is left in the play (uninverted) position, which is facing downwardly in FIGS. 10-13. This downwardly extending bumper 80 slightly elevates the pillow 12. Additionally, the straps 56 and 58 can be secured to the fastener strips "f" in this position. It should be noted that this configuration should not be used for infants as the elevated pillow poses a falling hazard.

The embodiments shown and described above are exemplary. Many details are often found in the art and, therefore, many such details are neither shown nor described herein. It is not claimed that all of the details, parts, elements, or steps described and shown were invented herein. Even though numerous characteristics and advantages of the present inventions have been described in the drawings and accompanying text, the description is illustrative only. Changes may be made in the details, especially in matters of shape, size, and arrangement of the parts within the principles of the inventions to the full extent indicated by the broad meaning of the terms of the attached claims. The description and drawings of the specific embodiments herein do not point out what an infringement of this patent would be, but rather provide an example of how to use and make the invention. Likewise, the abstract is neither intended to define the invention, which is measured by the claims, nor is it intended to be limiting as to the scope of the invention in any way. Rather, the limits of the invention and the bounds of the patent protection are measured by and defined in the following claims.

What is claimed is:

1. A pillow and play mat assembly comprising:

an infant support pillow comprising a central well and a bolster surrounding the central well, wherein the pillow sized to support the body of an infant in a prone position, wherein the pillow includes a top surface and a bottom surface and a sidewall defining the perimeter of the pillow and extending between the top surface and the bottom surface, and wherein the perimeter of the pillow includes an attachment section; and an infant play mat comprising a panel having a top surface and a bottom surface and an peripheral edge, wherein the peripheral edge includes an attachment section and a bumper section, wherein the attachment section of the peripheral edge of the panel is engaged with the attachment section of the infant support pillow, and wherein the play mat further comprises a flexible bumper extending from the peripheral edge of the panel, wherein the bumper is repositionable between a play position and an inverted position, wherein in the play position the bumper extends upwardly from the peripheral edge to enclose a play area defined thereby, and wherein in the inverted position, the bumper extends in the opposite direction of the play position;

whereby the pillow assembly is configurable alternately in a deployed position and a collapsed position, wherein in the deployed position the play mat extends sidewardly from the support pillow and the play mat bumper is in the play position, and wherein in the collapsed position the play mat is folded underneath the support pillow and the play mat bumper is in the inverted position thereby at least partially enclosing the sidewall of the pillow.

2. The pillow and play mat assembly of claim 1 wherein the attachment section of the play mat is nonremovably engaged with the attachment section of the pillow perimeter.

3. The pillow and play mat assembly of claim 1 wherein the pillow comprises a fabric enclosure and a pillow insert removably insertable in the fabric cover of the pillow.

4. The pillow and play mat assembly of claim 3 wherein the play mat side wall comprises a fabric enclosure and a sidewall insert removably insertable in the fabric enclosure of the play mat sidewall.

5. The pillow and play mat assembly of claim 1 wherein the play mat bumper comprises a fabric enclosure and a bumper insert removably insertable in the fabric enclosure of the play mat bumper.

6. The pillow and play mat assembly of claim 1 further comprising a cinch assembly on the sidewall of the pillow to adjust the girth of the pillow.

7. The pillow and play mat assembly of claim 6 wherein the cinch assembly comprises a pair of straps adjustably connectable to each other.

8. The pillow and play mat assembly of claim 7 wherein the cinch assembly is adapted to form a handle for carrying the pillow assembly when the pillow assembly is in the collapsed mode.

9. The pillow and play mat assembly of claim 8 wherein the pair of straps is located adjacent to the inter-engaged attachment sections of the pillow and the play mat, wherein the inter-engaged attachment sections have a length with a first end and a second end, wherein the bumper of the play mat has a first end adjacent to the first end of the inter-engaged attachment sections and a second end adjacent to the second end of the inter-engaged attachment sections, and wherein each of the pair of straps has a free end adjustably and removably attachable to one of the first and second ends of play mat bumper.

10. The pillow and play mat assembly of claim 1 further comprising a pair of straps located adjacent to the inter-engaged attachment sections of the pillow and the play mat, wherein the inter-engaged attachment sections have a length with a first end and a second end, wherein the play mat bumper has a first end adjacent to the first end of the inter-engaged attachment sections and a second end adjacent to the second end of the inter-engaged attachment sections, and wherein each of the pair of straps has a free end adjustably and removably attachable to a different one of the first and second ends of the play mat bumper.

11. The pillow assembly of claim 10 wherein the pair of straps is further defined as adapted to form a handle for carrying the pillow assembly when the pillow assembly is in the collapsed mode.

12. The pillow and play mat assembly of claim 1 wherein the pillow has a front and a back and a thickness and wherein the thickness of the pillow gradually increases from the front to the back.

13. The pillow and play mat assembly of claim 1 wherein the central well of the pillow comprises an elastic panel.

14. The pillow and play mat assembly of claim 1 wherein the pillow assembly is further defined as configurable alternately in an intermediate position wherein the play mat is folded under the pillow with the bumper in the play position thereby elevating the pillow.

* * * * *

UNITED STATES PATENT AND TRADEMARK OFFICE

CERTIFICATE OF CORRECTION

PATENT NO. : 8,914,927 B1
APPLICATION NO. : 14/108639
DATED : December 23, 2014
INVENTOR(S) : Jamie S. Leach It is certified that error appears in the above-identified patent and that said Letters Patent is hereby corrected as shown below:

Title Page:

Page 2, Col. 2, Other Publications, under item (56), reference #7, line 1, replace “Nap n Pack” with --Nap N Pack--.
Page 2, Col. 2, Other Publications, under item (56), reference #8, line 1, replace “Roam 'n Holiday” with -- Roam 'N Holiday--.

In the Specification:

Column 1, line 52: replace “13 a” with --13 is a--.
Column 2, line 53: replace “than” with --that--.

In the Claims:

Column 4, line 55: replace “sized” with --is sized--.

Signed and Sealed this
Twenty-eighth Day of April, 2015

Michelle K. Lee

Michelle K. Lee
*Director of the United States Patent and Trademark Office*